United States Patent [19]

Fukunaga et al.

[11] Patent Number: 4,775,781

[45] Date of Patent: Oct. 4, 1988

[54] COUNTER RESET ARRANGEMENT

[75] Inventors: Takahiro Fukunaga; Shoichiro Yoshiura, both of Nara, Japan

[73] Assignee: Sharp Kabushiki Kaisha, Osaka, Japan

[21] Appl. No.: 49,160

[22] Filed: May 13, 1987

[30] Foreign Application Priority Data

May 16, 1986 [JP] Japan ..... 61-112972
Jun. 4, 1986 [JP] Japan ..... 61-130615

[51] Int. Cl.[4] ..... G03G 15/00
[52] U.S. Cl. ..... 235/144 E; 355/14 CU
[58] Field of Search ..... 355/3 DD, 14 CU, 14 R; 377/30; 235/144 E, 144 M

[56] References Cited

U.S. PATENT DOCUMENTS 4,585,327 4/1986 Suzuki ..... 355/14 CU

*Primary Examiner*—John S. Heyman
*Attorney, Agent, or Firm*—Birch, Stewart, Kolasch & Birch

[57] ABSTRACT

A counter reset arrangement employed in an image forming apparatus such as a photocopier which is provided with a cartridge removably mounted in a main body of the apparatus and internally accommodating at least a photoreceptor and a cleaning unit integrally, and a resettable counter securely mounted in the main body of the apparatus to detect a remaining service life of the cartridge. The counter reset arrangement includes a reset member movably disposed in the cartridge and having a first protruding portion pressed against at a first position when mounting the cartridge, by a cabinet provided in the apparatus and a second protruding portion formed to press against a reset pin disposed on the counter to reset it. The counter reset arrangement further includes a first plate-like member disposed inside the cartridge to bias the reset member towards its second position where the first protruding portion is kept out of contact with the cabinet, so that the reset member is shifted to its second position after the counter has been reset by the second protruding portion through movement of the reset member caused by the cabinet and a second plate-like member also disposed inside the cartridge to bias the reset member against the first plate-like member towards its first position so that the reset member can be returned to the first position.

3 Claims, 3 Drawing Sheets

COUNTER RESET ARRANGEMENT

BACKGROUND OF THE INVENTION

The present invention generally relates to a counter reset mechanism employed in an image forming apparatus and more particularly, to a counter reset arrangement capable of resetting a counter which is employed to detect or keep count of the remaining useful life of consumable elements such as a photoreceptor, a cleaning unit or the like at a time when the cartridge containing the elements is mounted in or dismounted from the image forming apparatus.

According to a recent trend of image forming apparatus such as copying apparatus or the like towards small size and minimizing maintenance requirements, the image forming apparatus is constructed so that a photoreceptor drum and its environmental parts are integrally incorporated into a cartridge so that they are replaceable at the time when service life thereof is about to expire or has expired. In such a construction the environmental parts i.e., a corona charger, a cleaning unit and the like are integrally incorporated together with the photoreceptor drum into a cartridge. Thus, when the photoreceptor drum needs to be replaced or when the cleaning unit has accumulated full amount of superfluous toner particles, a user must simply replace the entire cartridge without necessity for calling servicing personnel. Accordingly, the user may advantageously readily deal with such situation by himself without the necessity of any servicing personnel for maintenance.

Meanwhile, in a cartridge of this kind, the service life of the photoreceptor drum is detected by a counter disposed on the main body of the copying apparatus in accordance with the amount of use thereof and, whenever the counter has reached a predetermined amount of use, the user is urged to replace the photoreceptor drum upon indication of the condition thereof on an operation panel. When the cartridge of the type having a counter which can not be reset is in use, however, the user can occasionally forget to record indicated value of the counter at the time of replacement of the cartridge. Furthermore, even in the case where a counter reset arrangement capable of resetting the counter is provided in the cartridge, the user may inadvertently fail to reset the counter by actuation of the counter reset arrangement. For the purpose of avoiding the above described problems, in one of the conventional copying apparatus, a protruding piece which can be broken off is formed on the end portion of a magazine, i.e., the cartridge including the photoreceptor drum, with the counter being mounted in the main body of the copying apparatus so as to confront the protruding piece. In the copying apparatus having such construction, the counter reset arrangement is automatically operated in the case of mounting the magazine into the main body, and the protruding piece is broken off the magazine so as not to further affect the counter reset arrangement. Such apparatus is disclosed, for example, in Japanese Utility Model Laid-open Application (Jikkaisho) No. 59-176059.

In the apparatus of this kind, however, since the protruding piece is broken off by being forcibly pressed towards the counter when the magazine is mounted, in the case where the protruding piece is made of synthetic resin and drops inside the main body of the copying apparatus, it occasionally contacts a liquid accommodated therein, thus resulting in an undesirable chemical reaction. In the case where the protruding piece is made of metallic material, it occasionally bites into rollers or the like to disadvantageously damage them. Moreover, this kind of copying apparatus is so designed that when the magazine has been once mounted therein, the same magazine can no longer execute the reset operation and thus cannot be removed from apparatus until the replacement thereof is required. Accordingly, there exists an inconvenience such that the operation of the counter reset arrangement cannot be checked during production process.

SUMMARY OF THE INVENTION

Accordingly, the present invention has been developed with a view to substantially eliminating the above described disadvantages inherent in the prior art counter reset arrangement, and has for its essential object to provide an improved counter reset arrangement which can be checked in its operation during the production process, and in which the operation of the counter is reliably ensured, with an image forming apparatus internally accommodating the counter reset arrangement of the present invention being freed from possible damage caused thereby.

Another important object of the present invention is to provide a counter reset arrangement of the above described type which is simple in construction and can be readily manufactured at low cost.

In accomplishing these and other objects, according to one preferred embodiment of the present invention, there is provided a counter reset arrangement employed in an image forming apparatus which is provided with a cartridge detachably mounted in a main body thereof and internally accommodating at least a photoreceptor and a cleaning unit integrally, and a resettable counter securely mounted in the main body thereof to detect the remaining service life of the cartridge. The counter reset arrangement includes a reset member movably disposed in the cartridge and having a first protruding portion pressed, at a first position thereof in case of mounting of the cartridge, by a cabinet provided in the apparatus and a second protruding portion formed to contact a reset pin disposed on the counter to reset it. The counter reset arrangement further includes a first plate-like member disposed inside the cartridge to bias the reset member towards a second position thereof where the first protruding portion is never pressed by the cabinet, so that the reset member is shifted up to the second position after the counter has been reset by the second protruding portion through movement of the reset member caused by the cabinet and a second plate-like member also disposed inside the cartridge to bias the reset member against the first plate-like member towards the first position thereof.

BRIEF DESCRIPTION OF THE DRAWINGS

These and other objects and features of the present invention will become apparent from the following description taken in conjunction with the preferred embodiment thereof with reference to the accompanying drawings, throughout which like parts are designated by like reference numerals, and in which.

DETAILED DESCRIPTION OF THE PREFERRED EMBODIMENT

Figure 1:
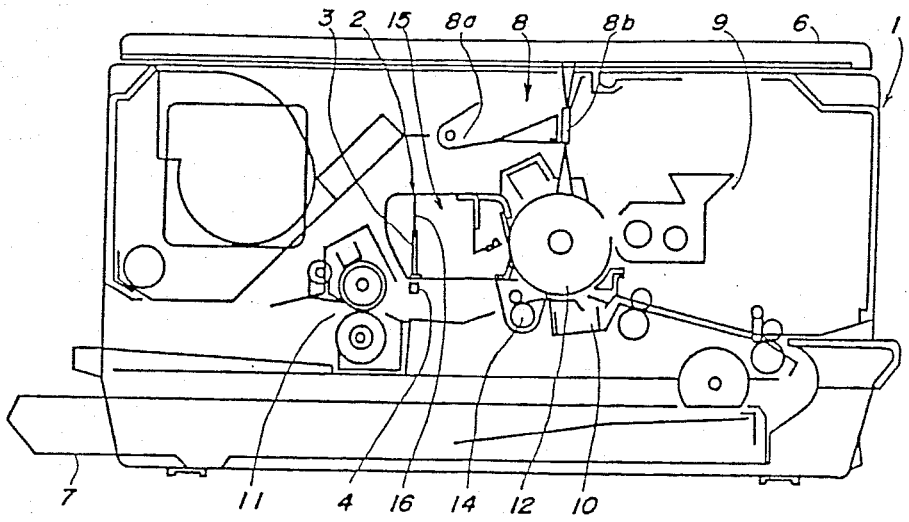
FIG. 1 is a schematic diagram of a copying apparatus internally accommodating a counter reset arrangement of the present invention.

Referring now to the drawings, there is shown in FIG. 1, a copying apparatus 1 internally accommodating a counter reset arrangement of the present invention.

With reference to FIGS. 1 through 5, the construction of the copying apparatus 1 will be explained hereinbelow.

Figure 4:
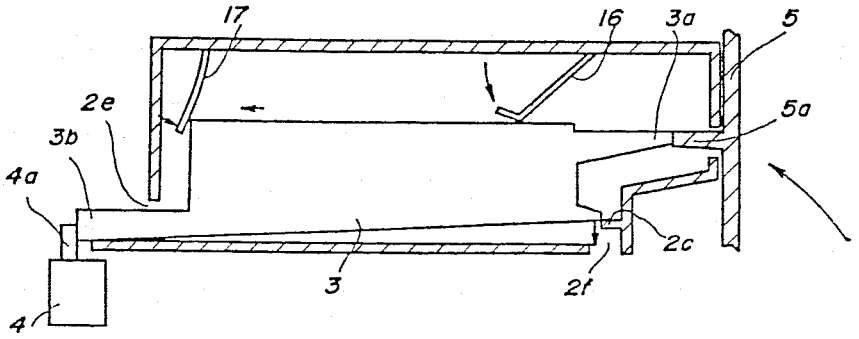
FIGS. 4 and 5 are views each similar to FIG. 3 for particularly explaining a reset operation of the counter reset arrangement.
Figure 5:
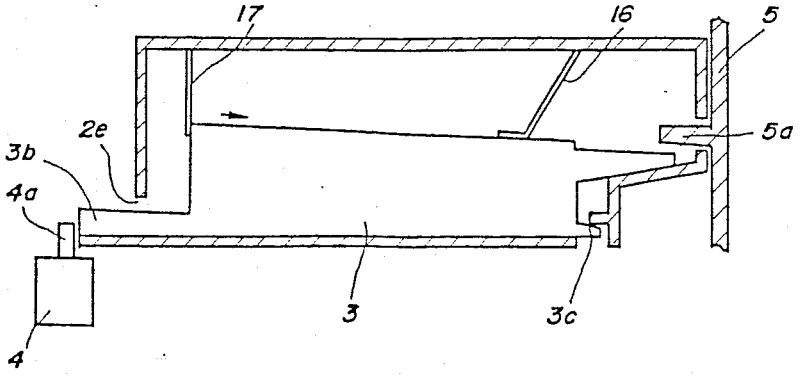

The counter reset arrangement of the present invention is disposed substantially at the central portion of the copying apparatus 1 and is provided, at a principal portion thereof, with a reset plate 3 accommodated in a cartridge 2 which is detachably mounted in the copying apparatus 1. A counter 4 securely mounted on the main body of the copying apparatus 1 can be reset by the counter reset arrangement through the reset plate. As shown in FIGS. 4 and 5, there is disposed at the front face of the main body of the copying apparatus 1, a cabinet 5 hingedly mounted, at its lower edge, on a supporting portion (not shown) provided in the copying apparatus 1. The cabinet 5 can be freely opened or closed around the supporting portion and is provided with a convex portion 5*a* projecting towards the main body of the copying apparatus 1.

An original platform 6 is horizontally movably disposed on the upper surface of the main body of the copying apparatus 1 and, a paper feed tray 7 is detachably mounted on the lower surface thereof. There are disposed around the cartridge 2 substantially at the central portion of the main body of the copying apparatus 1, an optical system unit 8 including a light source 8*a* and a collective light transmitter 8*b*, a developing device 9, a transfer charger 10, fixing rollers 11 and the like.

Figure 2:
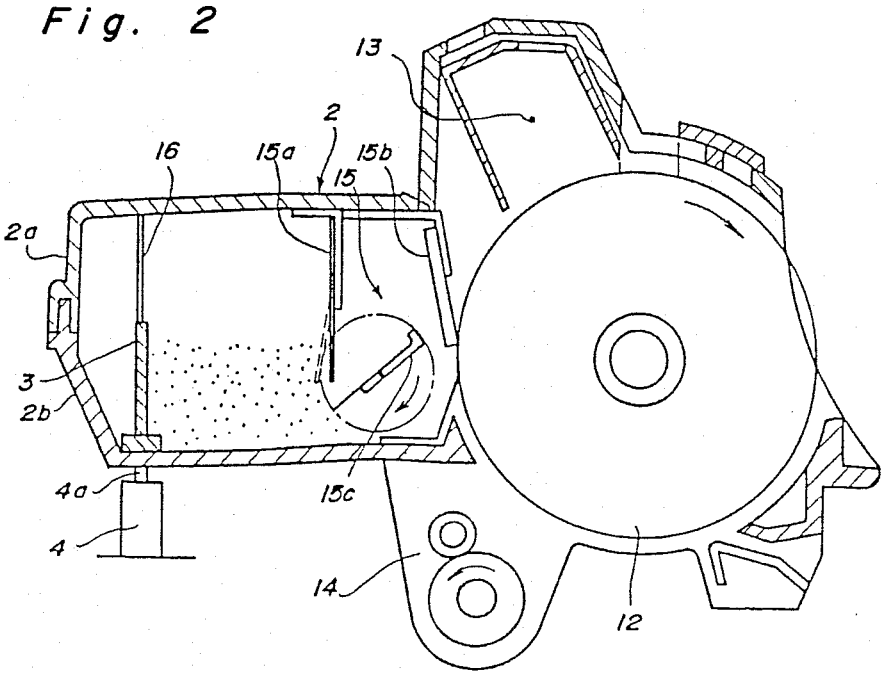
FIG. 2 is an enlarged sectional view of a cartridge provided in the copying apparatus of FIG. 1.
Figure 3:
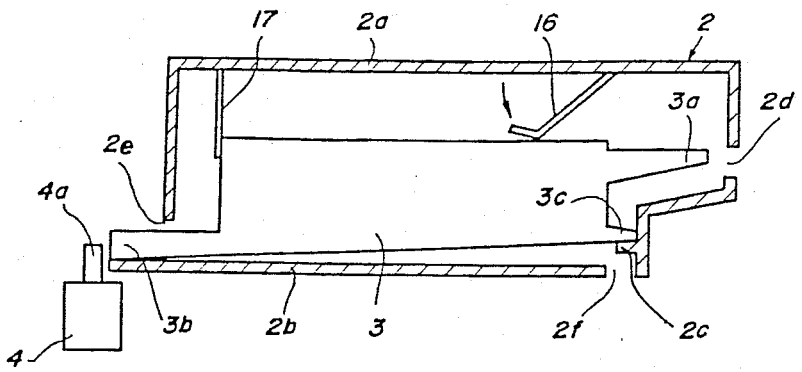
FIG. 3 is a side sectional view of the counter reset arrangement of the present invention and a counter affected thereby.

FIG. 2 illustrates a section of the cartridge 2 mounted in the copying apparatus 1. The cartridge 2 is provided with an upper frame 2*a* and a lower frame 2*b*, both of which are engaged, at their end portions, with each other to be integrally incorporated in the copying apparatus 1. A photoreceptor drum 12, a main corona charger 13, a scraper unit 14 and a cleaning unit 15 are disposed in the vicinity of the cartridge 2. The cleaning unit 15 internally accommodates a partition plate 15*a*, a cleaning blade 15*b*, a toner collecting rotary plate 15*c* and the like so that toner particles remaining on the photoreceptor drum 12 may be scraped down to be collected inside the cartridge 2. As shown in FIG. 3, there are disposed on and inside the upper frame 2*a* of the cartridge 2, a plate-like first biasing member 16 having one end bent and a second biasing member 17 of a flat plate, both of which are directed downwards and spaced from each other at a predetermined interval for the purpose of biasing the reset plate 3 under a certain pressure. Moreover, the lower frame 2*b* is provided with a reset plate receiving portion 2*c* protruding in the horizontal direction, a front opening 2*d* defined in one face thereof confronting the cabinet 5 and a rear opening 2*e* defined in the other face thereof located on the side of a reset pin 4*a* of a counter 4 disposed inside the main body of the copying apparatus 1. In addition, another opening 2*f* is defined in the lower surface of the lower frame 2*b*, particularly in the vicinity of the reset plate receiving portion 2*c* of the cartridge 2. Since each of the openings 2*d* and 2*e* is formed sufficiently in a small size at corner portions of the cartridge 2 and covered with a shielding plate (not shown), superfluous toner particles are prevented from spilling out into the copying apparatus 1.

As shown in FIGS. 3 through 5, the reset plate 3 accommodated in the cartridge 2 is of a substantially rectangular flat shape and has at one end thereof, a first protruding portion 3*a* confronting the front opening 2*d* of the cartridge 2 and designed to be pressed inwards by the convex portion 5*a* of the cabinet 5, and a projection 3*c* directed towards the reset plate receiving portion 2*c* formed on the lower frame 2*b* of the cartridge 2. Furthermore, the reset plate 3 has a second protruding portion 3*b* formed at the other end thereof opposite from the first protruding portion 3*a* and the projection 3*c*, with the second protruding portion 3*b* being directed towards the reset pin 4*a* of the counter 4. When the reset plate 3 is accommodated in the cartridge 2, the projection 3*c* is placed on the reset plate receiving portion 2*c* of the lower frame 2*b* and the second protruding portion 3*b* extends through the rear opening 2*e* of the cartridge 2 as shown in FIG. 3. In this condition, the reset plate 3 is not only restricted by the second biasing member 17 from moving towards the rear opening 2*e*, but is also biased downwards by the first biasing member 16.

The counter 4 is disposed inside the main body of the copying apparatus 1 and functions to detect or count the amount of use of the copying apparatus 1 to inform a user when the cartridge 2 should be replaced, by emitting a signal when the counter 4 has counted a predetermined value. When the cartridge 2 has been properly set in the copying apparatus 1, the counter 4 is reset by having reset pin 4*a* disposed at the upper portion thereof horizontally displaced by the reset plate 3 as shown in FIG. 4. The reset pin 4*a* is restored to its former position when the biasing force has been released therefrom by having projection 3*c* move off receiving portion 2*c* and into opening 2*f* as shown in FIG. 5.

The operation of the counter reset arrangement of the present invention will be described hereinafter.

The cabinet 5 of the copying apparatus 1 is initially opened so that the cartridge 2 may be mounted in the copying apparatus 1. When the cabinet 5 is then angularly closed in a direction as shown by an arrow in FIG. 4, the first protruding portion 3*a* of the reset plate 3 is biased against the convex portion 5*a* of the cabinet 5. The reset plate 3 is then caused to move towards the counter 4 and the reset pin 4*a* of the counter 4 is caused to move horizontally under the biasing force of the second protruding portion 3*b* so that the counter 4 is reset. Upon movement of the reset plate 3, the projection 3*c* is disengaged from the reset plate receiving portion 2*c* and the reset plate 3 drops vertically under the influence of the biasing force by the first biasing member 16. At this moment, since the reset plate 3 is restored towards the cabinet 5 as shown in FIG. 5, by the biasing force from the second biasing member 17, the second protruding portion 3*b* is retracted from the reset pin 4*a* of the counter 4. As a result, the reset pin 4*a* is returned to its former position, with the counter being reset so that the number counted may be restored to zero.

From the foregoing, according to the counter reset arrangement of the present invention, since the reset plate 3 accommodated in the cartridge 2 is caused to effect the reset pin 4*a* of the counter 4 at the time the cartridge 2 is mounted in the copying apparatus 1, the reset operation of the counter 4 is reliably ensured. Moreover, since the counter 4 can be examined in its operation simply by moving the reset plate 3, it becomes possible to make an examination of the operation of the counter 4 during the production process. In the case where the operation of the counter 4 has been once examined, for example, the reset plate 3 accommodated in the cartridge 2 is transferred to its non-operable position as shown in FIG. 5, where the counter 4 is not reset thereby anymore. If the reset plate 3 is restored to its operable position as shown in FIG. 3, where the reset operation of the counter 4 can be executed thereby, such operation can be again examined with the use of the same cartridge 2.

Figure 6:
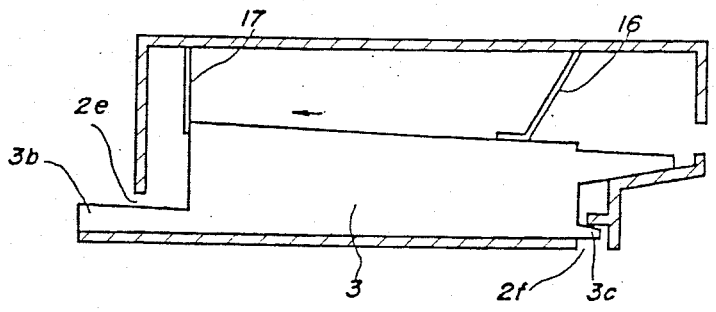
FIGS. 6 through 8 are side sectional views of the counter reset arrangement for particularly explaining a restoring operation of a reset plate of the counter reset arrangement.
Figure 7:
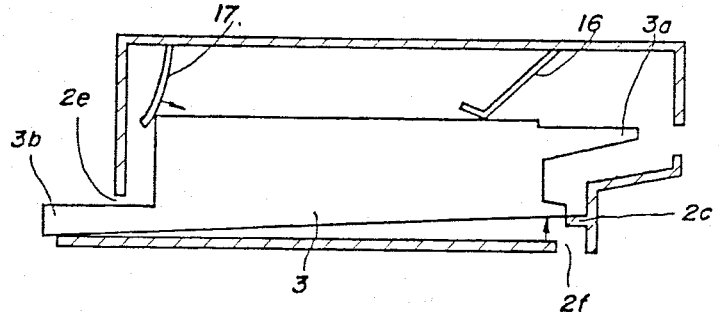
Figure 8:
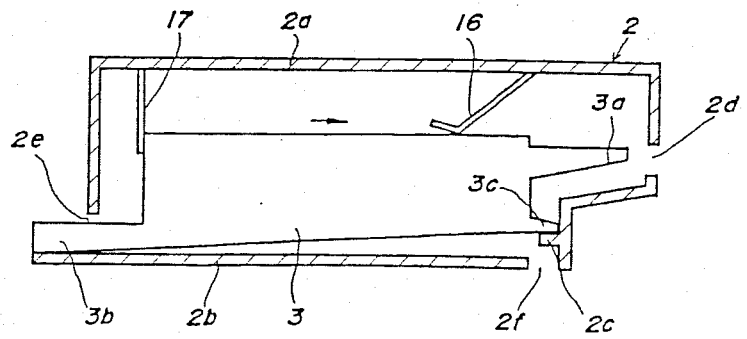

To this end, after the cartridge 2 has been taken out of the copying apparatus 1 as shown in FIG. 6, the projection 3*c* of the reset plate 3 can be pressed against the second biasing member 17 manually through the opening 2*f* defined at the lower face of the cartridge 2. At this moment, since the forward end of the projection 3*c* of the reset plate 3 is away from the reset plate receiving portion 2*c* of the cartridge 2, if the reset plate 3 is raised against the first biasing member 16 as shown in FIG 7, the projection 3*c* of the reset plate 3 is shifted onto the reset plate receiving portion 2*c* of the cartridge 2. Thereafter, the reset plate 3 is caused to move in a direction shown by an arrow in FIG. 8 under the influence of the biasing force by the second biasing member 17, and restored to its operable position, with the projection 3*c* of the reset plate 3 being desirably set on the reset plate receiving portion 2*c* of the cartridge 2.

It is to be noted that the counter reset arrangement of the present invention is not limited by the above described construction such that it is brought into operation at the time when the cabinet 5 of the copying apparatus 1 is angularly closed with respect to the cartridge 2, but the counter may be reset by another construction different from the above. For example, in a copying apparatus internally accommodating a cartridge which is removable through opening or closing of an upper unit thereof, the counter may be reset by such an arrangement that a counter reset arrangement is provided at a location opposed to the upper unit and the convex portion is formed on the upper unit.

According to the counter reset arrangement of the present invention, it is capable of resetting the counter through operation of the reset pin disposed therein, which follows the movement of the reset plate at the time when the cartridge is set in an image forming apparatus such as a copying apparatus. Since the counter is caused not to be reset again by such construction, the reset operation of the counter is reliably ensured. Furthermore, the reset plate is transferred, within the cartridge, to its non-operable position where the counter cannot be reset thereby, after the reset plate has finished the reset operation towards the counter and the reset plate can be again restored to its operable position as described above. Since the operation of the counter can be examined on each occasion, the operation of the counter may be examined during the production process. In addition, since the counter is operated by a plurality of protruding or convex portions formed on the reset plate, no part of the copying apparatus is ever damaged and as a result, such a conventional problem is avoided.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A counter arrangement for an image forming apparatus including a removable cartridge mounted in a main body of said apparatus, said cartridge containing at least one consumable element of limited service life, said apparatus further including a resettable counter mounted in said main body for keeping count of the remaining service life of said cartridge, comprising:

a reset member movably disposed in said cartridge between first and second positions and having a first protruding portion contacted by closure of a cabinet of said apparatus in said first position upon mounting in said main body and a second protruding portion contacting a reset pin of said counter to reset said counter, said second protruding portion displacing said reset pin to reset said counter upon movement of said reset member by closure of said cabinet; and first means for biasing said member to said second position in which said first protruding portion is placed out of contact with said cabinet and said second protruding portion is placed out of contact with said reset pin, said reset member being moved to said second position after said counter has been reset by movement of said reset pin.

2. A counter reset arrangement as claimed in claim 1, further comprising second means for biasing said reset member against said first means towards said first position so that said reset member may be restored to said first position.

3. A counter reset arrangement as claimed in claim 2, wherein said first means is a plate-like member biasing said reset member downwards and said second means is also a plate-like member biasing said reset member towards said cabinet.

* * * * *